US007143455B2

(12) United States Patent
Cordray et al.

(10) Patent No.: US 7,143,455 B2
(45) Date of Patent: Dec. 5, 2006

(54) POOL COVER

(76) Inventors: Steven J. Cordray, 106 Syracuse Ave., Medford, NY (US) 11763; Joseph A. Kiesel, Jr., 119 Timber Ridge Dr., Holbrook, NY (US) 11741

( * ) Notice: Subject to any disclaimer, the term of this patent is extended or adjusted under 35 U.S.C. 154(b) by 77 days.

(21) Appl. No.: 10/720,335

(22) Filed: Nov. 25, 2003

(65) Prior Publication Data

US 2005/0108818 A1 May 26, 2005

(51) Int. Cl.
*E04H 4/10* (2006.01)

(52) U.S. Cl. ..... 4/503; 4/498; 24/334; 24/507

(58) Field of Classification Search ..... 4/498, 4/503; 160/382, 402, 404; 24/334, 507
See application file for complete search history.

(56) References Cited

U.S. PATENT DOCUMENTS

| | | | | |
|---|---|---|---|---|
| 109,563 | A * | 11/1870 | Walton | 24/507 X |
| 644,894 | A * | 3/1900 | Carlin | 24/334 X |
| 2,870,455 | A | 1/1959 | Reeves | 4/498 |
| 3,593,757 | A | 7/1971 | Haynes | 4/498 X |
| 3,683,427 | A * | 8/1972 | Burkholz et al. | 4/503 X |
| 4,136,408 | A * | 1/1979 | Dahlbeck et al. | 4/498 |
| 5,095,557 | A | 3/1992 | Keyes | 4/503 |
| 5,239,709 | A | 8/1993 | Masoti | 4/503 |
| 5,338,284 | A | 8/1994 | Knelson | 494/28 |
| 5,388,314 | A | 2/1995 | Vella | 4/503 X |
| 5,608,926 | A | 3/1997 | Donaton | 4/503 |
| 5,826,283 | A | 10/1998 | Edwards | 4/503 |
| 6,523,189 | B1 | 2/2003 | Weatherbee | 4/498 |
| 6,606,752 | B1 | 8/2003 | Marbach | 4/498 X |
| 2003/0150055 | A1 | 8/2003 | Gillis | 4/498 |
| 2005/0055760 | A1 * | 3/2005 | Sutton et al. | 4/498 |

* cited by examiner

*Primary Examiner*—Robert M. Fetsuga
(74) *Attorney, Agent, or Firm*—Richard C. Litman

(57) ABSTRACT

A protective assembly for an above ground swimming pool includes a pool cover and plural clips for securing the cover to the pool coping. The cover is fabricated from lightweight, polyester, mesh material. The material has an open weave to allow sunlight and rain therethrough and allow complete circulation and filtration of pool water. However, the weave is of a gauge small enough to prevent debris from trees, insects, animals and the like from coming in contact with the water in the pool. Unique clips are provided so that the cover can be easily mounted to and removed from the pool structure.

3 Claims, 7 Drawing Sheets

POOL COVER

BACKGROUND OF THE INVENTION

1. Field of the Invention

The present invention generally relates to protective coverings. More specifically, the present invention is drawn to a cover for an above-ground swimming pool.

2. Description of the Related Art

The modern homeowner is constantly seeking ways to incorporate more recreational and exercise facilities in and around the home. In recent years the backyard swimming pool has increasingly become a popular addition as an at-home recreational outlet. A major drawback, however, is that maintenance of a pool requires a considerable expenditure of time. This time spent for maintenance cuts into the time that might be spent for relaxation and desired exercise. One way to shorten the maintenance time is to provide a suitable cover for a daily or even weekly application on the pool. By providing a cover, debris, insects and animals cannot contaminate the pool and discolor the water when the pool is not in use. A lightweight cover for an above-ground pool, which cover can be securely installed and quickly removed would certainly be a welcome addition to the art.

The related art is rife with covers for swimming pools. For example, U.S. Pat. No. 5,095,557 (Keyes) shows a cover that employs an adjustable ring assembly to secure the cover against the inner side of the pool's peripheral wall.

U.S. Pat. No. 5,826,283 (Edwards) discloses a pool cover having a continuous sleeve formed therearound. A belt is situated in the sleeve for securing the cover to the pool.

U.S. Pat. No. 6,523,189 B1 (Weatherbee) is drawn to a pool cover fabricated from mesh material and having an elastomeric securing member attached to its outer perimeter for extension around the periphery of the pool.

U.S. Patent Application Publication No. 2003/0150055 A1 (Gillis) discloses a cover having grommets positioned around the cover's periphery. Elastic tie-down straps are contemplated for fastening the grommets to the pool wall.

U.S. Pat. No. 6,606,752 B2 (Marbach) shows a pool having anchors disposed at predetermined positions on the pool. Laces on a pool cover can be tied to the anchors.

U.S. Pat. No. 2,870,455 (Reeves) is drawn to a cover designed to float upon the pool's surface.

U.S. Pat. No. 3,593,757 (Haynes) disclose a woven fabric material adapted to be utilized as a pool cover.

U.S. Pat. No. 5,239,709 (Masotti), U.S. Pat. No. 5,608,926 (Donation), U.S. Pat. No. 5,388,284 (Garnett) and U.S. Pat. No. 5,388,314 (Vella) show clip devices for securing a cover to the walls of swimming pools.

None of the above inventions and patents, taken either singly or in combination, is seen to disclose a pool cover and securing means therefor as will subsequently be described and claimed in the instant invention.

SUMMARY OF THE INVENTION

The instant invention is a protective assembly for an above ground swimming pool. The assembly includes a pool cover and plural clips for securing the cover to the outside or inside edge of the pool coping. The cover is fabricated from lightweight, polyester, mesh material. The material has an open weave to allow sunlight and rain therethrough, thereby allowing complete circulation and filtration of pool water. However, the weave is of a gauge small enough to prevent debris from trees, insects, animals and the like from coming in contact with the water in the pool. Unique clips are provided so that the cover can be easily mounted to and removed from the pool structure.

Accordingly, it is a principal object of the invention to provide a swimming pool cover assembly especially adapted for an above-ground swimming pool.

It is another object of the invention to provide a swimming pool cover assembly, which cover is fabricated from a lightweight mesh that does not collect water thereon.

It is a further object of the invention to provide a swimming pool cover assembly, which cover prevents access of environmental debris, insects and animals when the pool is not in use.

Still another object of the invention is to provide a swimming pool cover, which cover assembly includes unique clips for securing the cover to the outside or inside edge of the coping of the pool.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
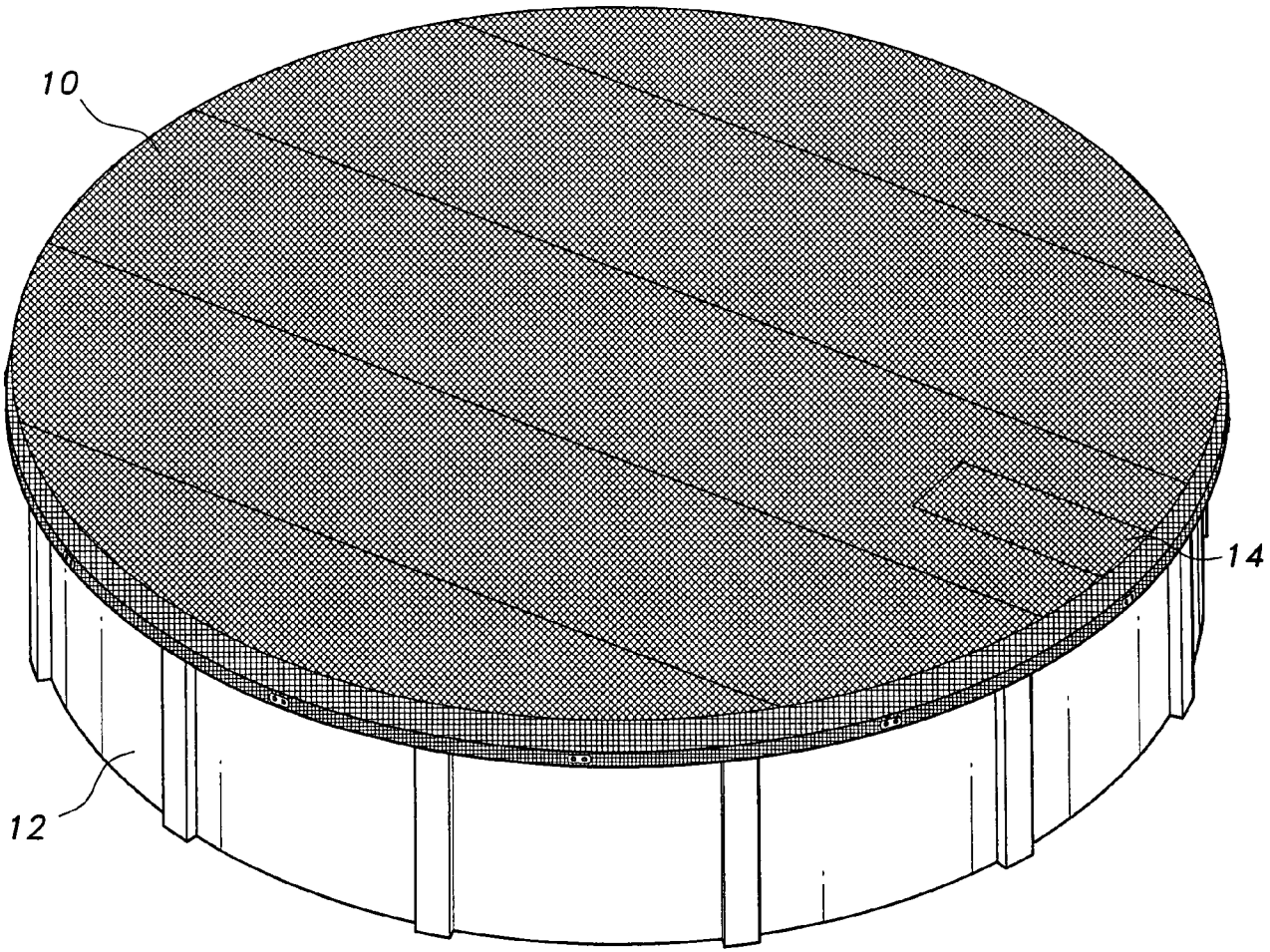
FIG. 1 is an environmental, perspective view of a pool cover according to the present invention.
Figure 2:
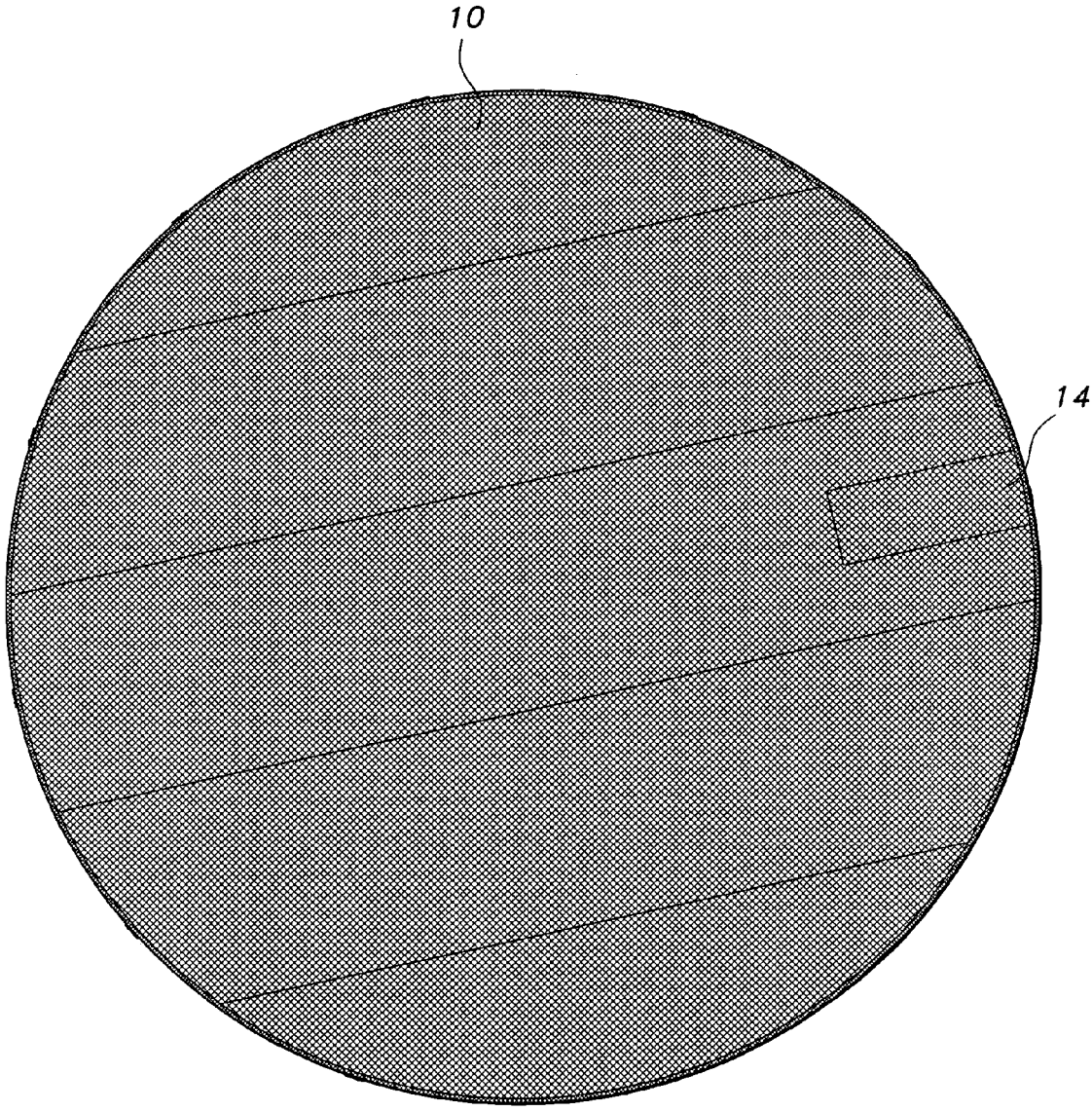
FIG. 2 is a top view of a pool cover according to the present invention.
Figure 3:
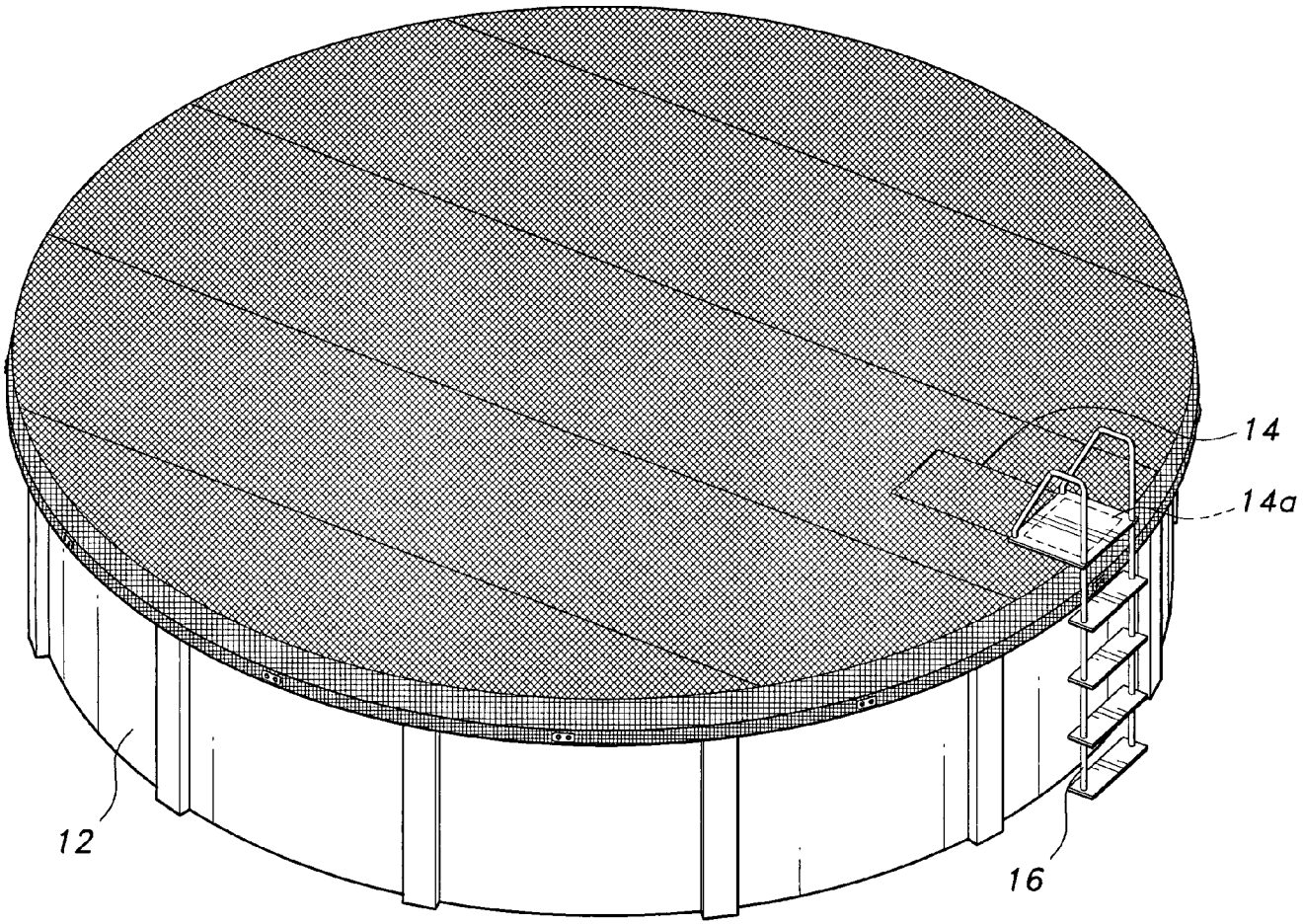
FIG. 3 is an environmental, perspective view of a pool cover with a ladder in place according to the present invention.

Attention is first directed to FIGS. 1–3 wherein the pool cover 10 of the present invention is mounted atop an above-ground swimming pool 12. Cover 10 is preferably woven as an open mesh and is fabricated from one-hundred per cent polyester yarn, which yarn has a weight of approximately 0.85 ozs./sq. yd. The yarn has a bursting strength of 30 as measured by ASTM Test Method D3787-89. This construction permits the cover to be lightweight for easy handling and strong enough to retain most environmental debris without rupturing. The cover is fabricated to be substantially colorfast under most conditions likely to be encountered. A flap 14 is disposed to cover an opening 14*a* (shown in phantom lines) at one circumferential area of the cover. Opening 14*a* is provided to accommodate a pool ladder 16. The peripheral edge of the cover is provided with a reinforced binding 10*a* (FIGS. 4A, 4B and 6) there around.

Figure 4A:
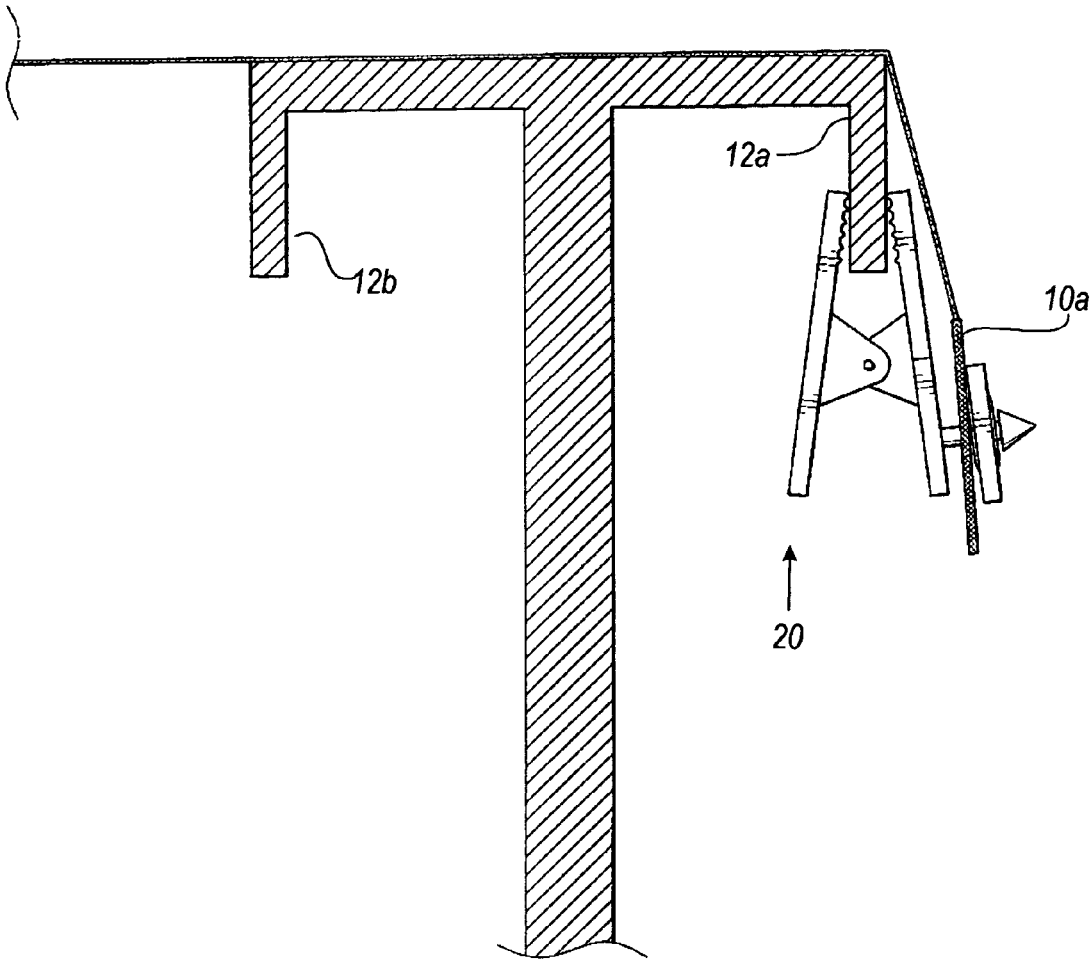
FIG. 4A is a partial view that shows the pool cover secured by a clip to the pool outside coping according to the present invention.
Figure 4B:
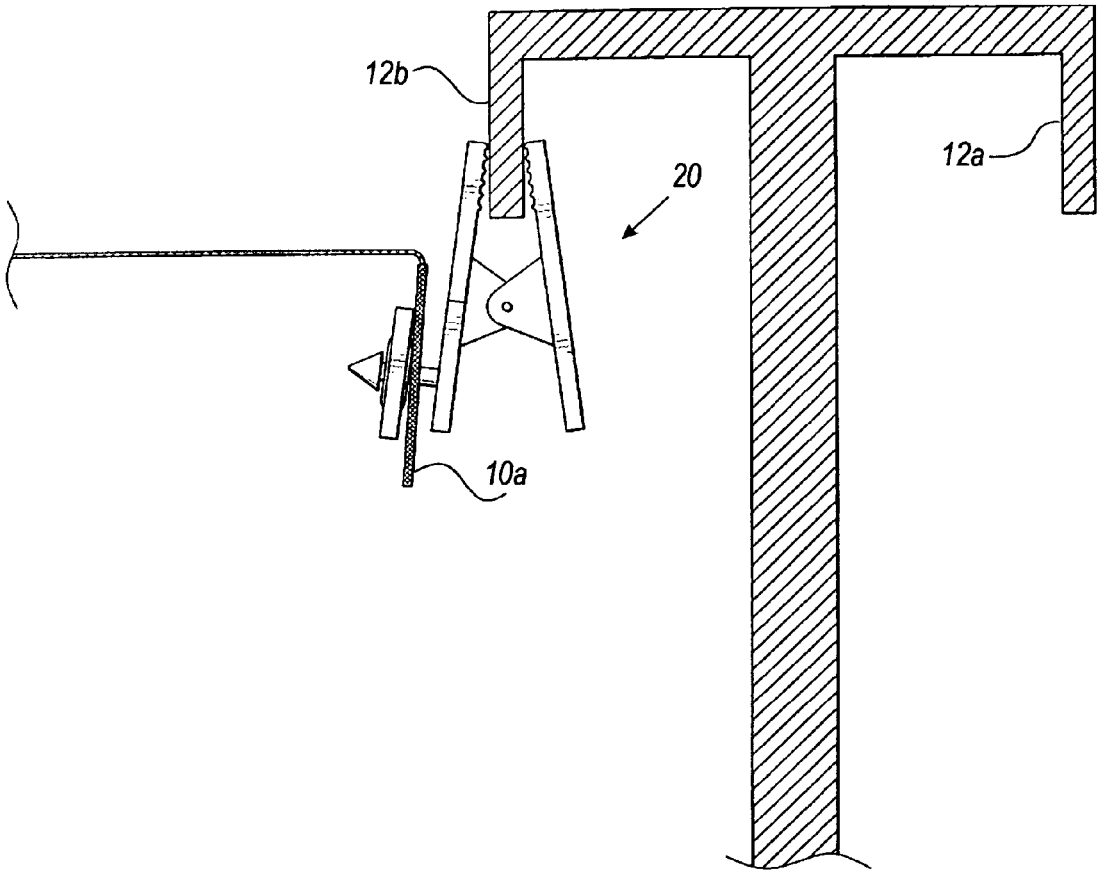
FIG. 4B is a partial view that shows the pool cover secured by a clip to the pool inside coping according to the present invention.
Figure 5:
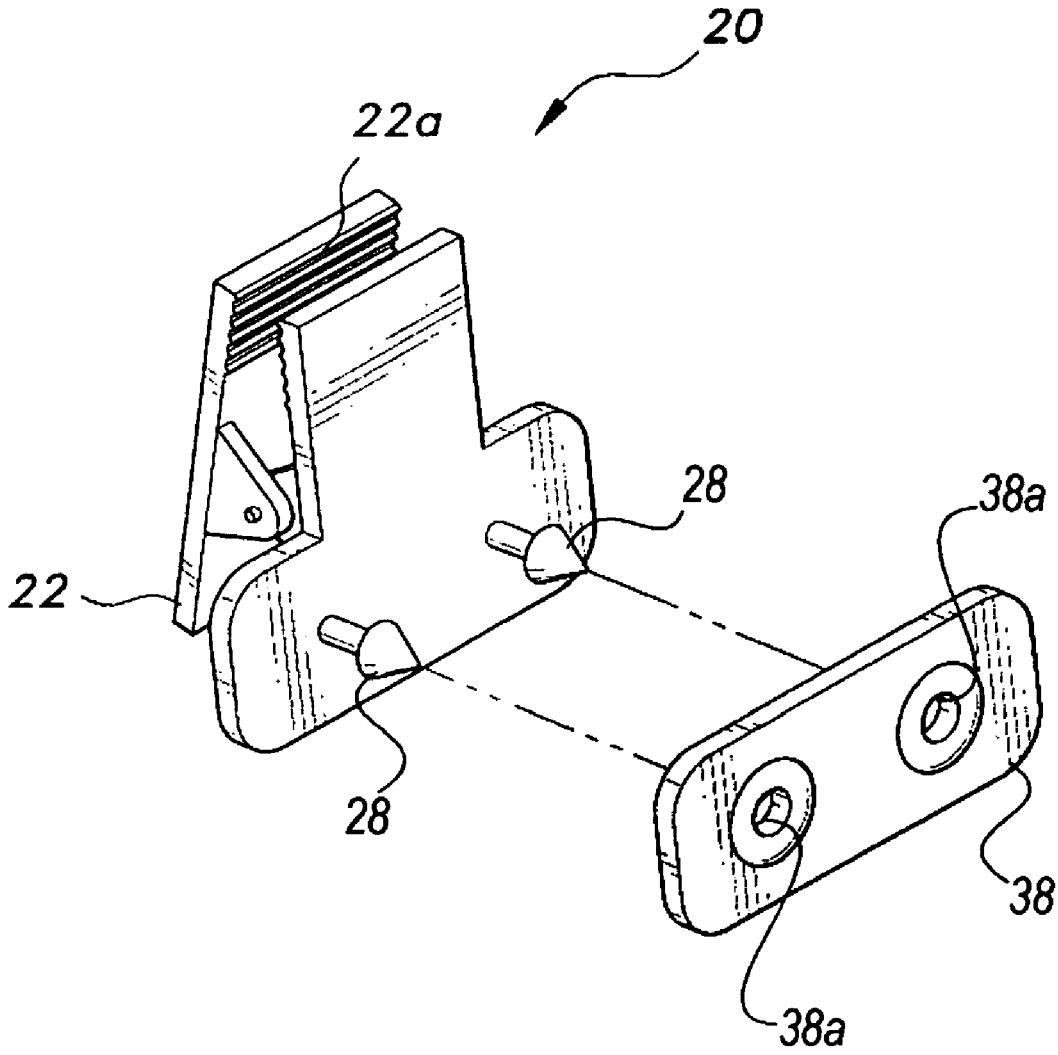
FIG. 5 is an exploded view of a clip utilized to secure a pool cover according to the present invention.
Figure 6:
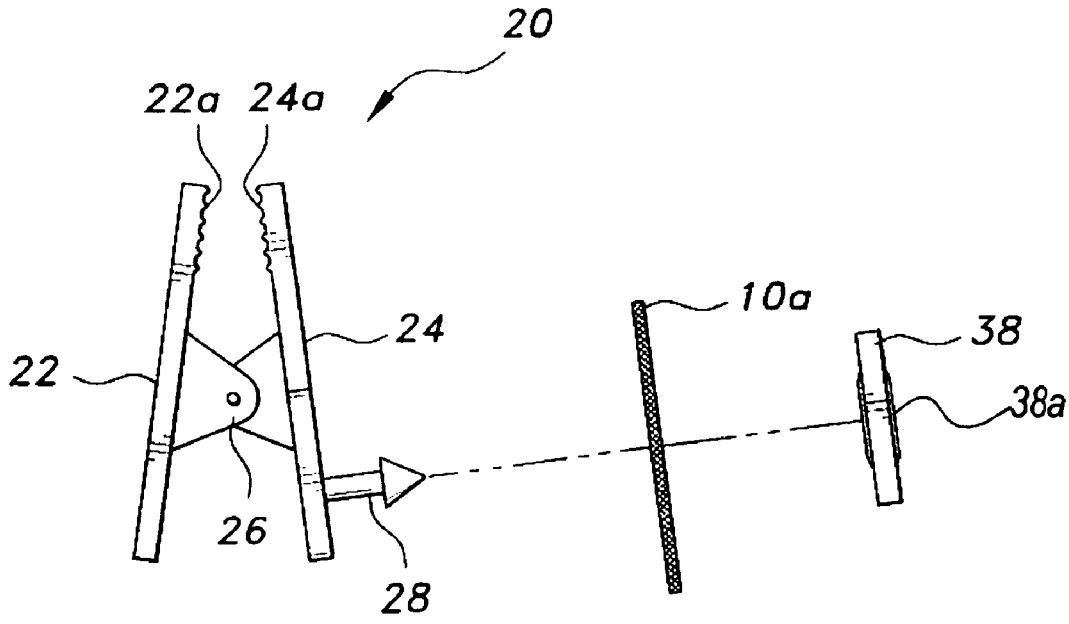
FIG. 6 is an exploded view that shows the clip and pool cover assembly according to the present invention.

As shown in FIGS. 4A and 4B, a spring-biased clip assembly 20 is utilized to secure cover 10 to the outside 12*a* or inside 12*b* of the pool coping. As best seen in FIGS. 5 and 6, clip assembly 20 comprises two flat handle members 22 and 24. At their upper ends, each handle member has gripping teeth 22*a*, 24*a* disposed on respective inside surfaces. A spring member 26 is disposed between the handle members and functions to bias the gripping teeth toward one another as is conventional and well known in the art. Handle member 24 is of a T-shaped configuration. The head portion of handle member 24 has two pointed plastic rivets 28 integral with and extending from the outside face thereof. Rivets 28 are adapted to engage clamp openings 38*a* in clamp 38 to secure reinforced binding 10*a* between handle member 24 and clamp 38. As contemplated, clip assemblies are spaced and attached to the cover around the periphery thereof. Since the clip assemblies are attached to the cover, a user has no need to search for the clips when it is desired to install the cover. All edges of the clip assembly are smooth and/or rounded to prevent snags. Although the cover is circular as illustrated and described, it is obvious that the cover could be made in other configurations if desired.

It is to be understood that the present invention is not limited to the embodiment described above, but encompasses any and all embodiments within the scope of the following claims.

We claim:

1. A pool cover assembly, comprising:

mesh cover member, said cover member having a peripheral edge therearound wherein said peripheral edge is a reinforced a binding;

a plurality of clip members, said clip members spaced around said peripheral edge and attached to said reinforced binding, each of said clip members including;

a first T-shaped handle member having an inner surface and an outer surface;

a second handle member having an inner surface and an outer surface, wherein each handle member has an upper end and wherein gripping teeth are disposed on the inner surface of each handle member at each respective upper end; and a clamp attached to said first T-shaped handle member.

2. The pool cover as recited in claim 1, wherein said reinforced binding interposes said first handle member and said clamp.

3. The pool cover as recited in claim 1 wherein said mesh cover member is fabricated from polyester yarn having a weight of approximately 0.85 ozs./sq. yd.

* * * * *